US012698922B2

(12) United States Patent
Seto et al.

(10) Patent No.: US 12,698,922 B2
(45) Date of Patent: Aug. 4, 2026

(54) HEAT SOURCE UNIT

(71) Applicant: Mitsubishi Electric Corporation, Tokyo (JP)

(72) Inventors: Naoki Seto, Tokyo (JP); Yu Tamaki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 76 days.

(21) Appl. No.: 18/838,453

(22) PCT Filed: Apr. 25, 2022

(86) PCT No.: PCT/JP2022/018665
§ 371 (c)(1),
(2) Date: Aug. 14, 2024

(87) PCT Pub. No.: WO2023/209753
PCT Pub. Date: Nov. 2, 2023

(65) Prior Publication Data
US 2025/0155157 A1 May 15, 2025

(51) Int. Cl.
*F24F 13/20* (2006.01)

(52) U.S. Cl.
CPC ..... *F24F 13/20* (2013.01)

(58) Field of Classification Search
CPC .... F24F 1/56; F24F 13/20; F24F 13/22; F24F 13/222; F24F 13/30; F24F 13/32
See application file for complete search history.

(56) References Cited

U.S. PATENT DOCUMENTS 10,208,968 B2 2/2019 Yanase et al.
2009/0108476 A1* 4/2009 Eping ..... F24F 6/00 261/83

(Continued)

FOREIGN PATENT DOCUMENTS

DE 202012010569 U1 * 1/2013 ..... B05B 14/44
JP S56-1717 U 1/1981

(Continued)

OTHER PUBLICATIONS

Extended European Search Report dated May 13, 2025 issued in corresponding European Patent Application No. 22940034.6.

(Continued)

*Primary Examiner* — Andrew Roersma
(74) *Attorney, Agent, or Firm* — Posz Law Group, PLC

(57) ABSTRACT

A heat source unit includes: a bottom plate having a wave-like shape including a series of alternating ridge and groove portions; and a pair of support legs located at opposite end portions of the bottom plate, between which the ridge and groove portions extend, the pair of support legs being configured to support the opposite end portions. Each of the support legs has a support portion on which an end portion of the bottom plate is placed, and a wall portion extending upward from the support portion. On an upper surface of the support portion, a recessed portion is formed at a connection part of the wall portion and the support portion. The bottom plate is installed so that an end portion of the bottom plate, to which the ridge and groove portions extend, passes over the recessed portion and abuts against a wall surface of the wall portion.

8 Claims, 5 Drawing Sheets

(56) References Cited

U.S. PATENT DOCUMENTS

| | | | | |
|---|---|---|---|---|
| 2016/0025357 | A1* | 1/2016 | Suzuki | F24F 1/0018 165/121 |
| 2016/0076796 | A1* | 3/2016 | Lee | F24F 13/22 62/498 |
| 2018/0049546 | A1* | 2/2018 | Vanliefde | A47B 91/005 |
| 2019/0128542 | A1 | 5/2019 | Furukubo et al. | |
| 2019/0137119 | A1 | 5/2019 | Koike et al. | |
| 2019/0186772 | A1 | 6/2019 | Zhong et al. | |
| 2020/0149760 | A1* | 5/2020 | Morikawa | F24F 13/30 |
| 2023/0168004 | A1* | 6/2023 | Kim | F24F 1/56 62/498 |

FOREIGN PATENT DOCUMENTS

| | | | | |
|---|---|---|---|---|
| JP | 2018-087698 | A | 6/2018 | |
| JP | 6361685 | B2 | 7/2018 | |
| WO | WO-2023276597 | A1 * | 1/2023 | F24F 12/006 |

OTHER PUBLICATIONS

International Search Report of the International Searching Authority mailed Jun. 14, 2022 in corresponding International Application No. PCT/JP2022/018665 (and English translation).

* cited by examiner

HEAT SOURCE UNIT

CROSS REFERENCE TO RELATED APPLICATION

This application is a U.S. national stage application of PCT/JP2022/018665 filed on Apr. 25, 2022, the contents of which are incorporated herein by reference.

TECHNICAL FIELD

The present disclosure relates to a heat source unit to be installed outdoors.

BACKGROUND ART

A heat source unit, which is a part of an air-conditioning apparatus or other apparatus, has been conventionally known as being installed outdoors. A heat source unit disclosed in Patent Literature 1 has a casing with a substantially cuboid box shape, a heat source side fan, and constituent components of a refrigerant circuit, including a compressor and a heat source side heat exchanger. The casing has a bottom frame with a wave-like shape made up of a series of alternating ridge portions and groove portions, and a pair of fixing legs located at opposite end portions of the bottom frame, between which the ridge portions and groove portions extend, and configured to support the opposite end portions. Each of the fixing legs has a support portion on which the end portion of the bottom frame is placed, and a wall portion extending upward from the support portion. The wall portion is formed such that its wall surface faces the end portion of the bottom frame placed on the support portion. Between the end portion of the ridge portions of the bottom frame and the wall portion of the fixing leg, there is a clearance to serve as a drainage channel through which water running on an upper surface of the ridge portions flows to the support portion.

CITATION LIST

Patent Literature

Patent Literature 1: Japanese Patent Publication No. 6361685

SUMMARY OF INVENTION

Technical Problem

However, since the heat source unit disclosed in Patent Literature 1 has a heat exchanger located along an outer peripheral edge of the bottom plate, the clearance serving as the drainage channel is located in vicinity to the bottom of the heat exchanger. In addition, the end portion of the bottom frame is supported on the upper surface of the support portion. For this reason, in order that the bottom frame is supported in a stabilized manner, the width of the clearance cannot be increased any further. However, a small width of the clearance prevents a sufficient amount of water from being drained, so that the water is more likely to accumulate in this clearance. For this reason, in a case where the heat source unit is installed in a cold region, water accumulating in the clearance freezes into ice. The ice may grow up to the heat exchanger positioned above the clearance, and is likely to damage the heat exchanger.

The present disclosure has been made to solve the above problems, and it is an object of the present disclosure to provide a heat source unit in which water collected on a bottom surface of a bottom plate is drained from drainage holes located away from a heat exchanger, so that it is possible to prevent the heat exchanger from being damaged due to growth of ice.

Solution to Problem

A heat source unit according to an embodiment of the present disclosure includes: a bottom plate having a wave-like shape made up of a series of alternating ridge portions and groove portions; and a pair of support legs located at opposite end portions of the bottom plate, between which the ridge portions and groove portions extend, the pair of support legs being configured to support the opposite end portions, wherein each of the support legs has a support portion on which an end portion of the bottom plate is placed, and a wall portion extending upward from the support portion, on an upper surface of the support portion, a recessed portion is formed at a connection part of the wall portion and the support portion, and the bottom plate is installed in such a manner that an end portion of the bottom plate, to which the ridge portions and groove portions extend, passes over the recessed portion and abuts against a wall surface of the wall portion.

Advantageous Effects of Invention

According to an embodiment of the present disclosure, the recessed portion is formed on the upper surface of the support portion at the connection part of the wall portion and the support portion, and the bottom plate is installed in such a manner that the end portion of the bottom plate, to which the ridge portions and groove portions extend, passes over the recessed portion and abuts against the wall surface of the wall portion. It is thus possible to close a clearance between the end portion of the bottom plate and the wall surface of the wall portion. Consequently, water collected on the bottom surface of the bottom plate can be drained from the drainage holes located away from the heat exchanger without accumulating at the corner portion. It is therefore possible to prevent the heat exchanger from being damaged due to growth of ice.

DESCRIPTION OF EMBODIMENTS

Figure 1:
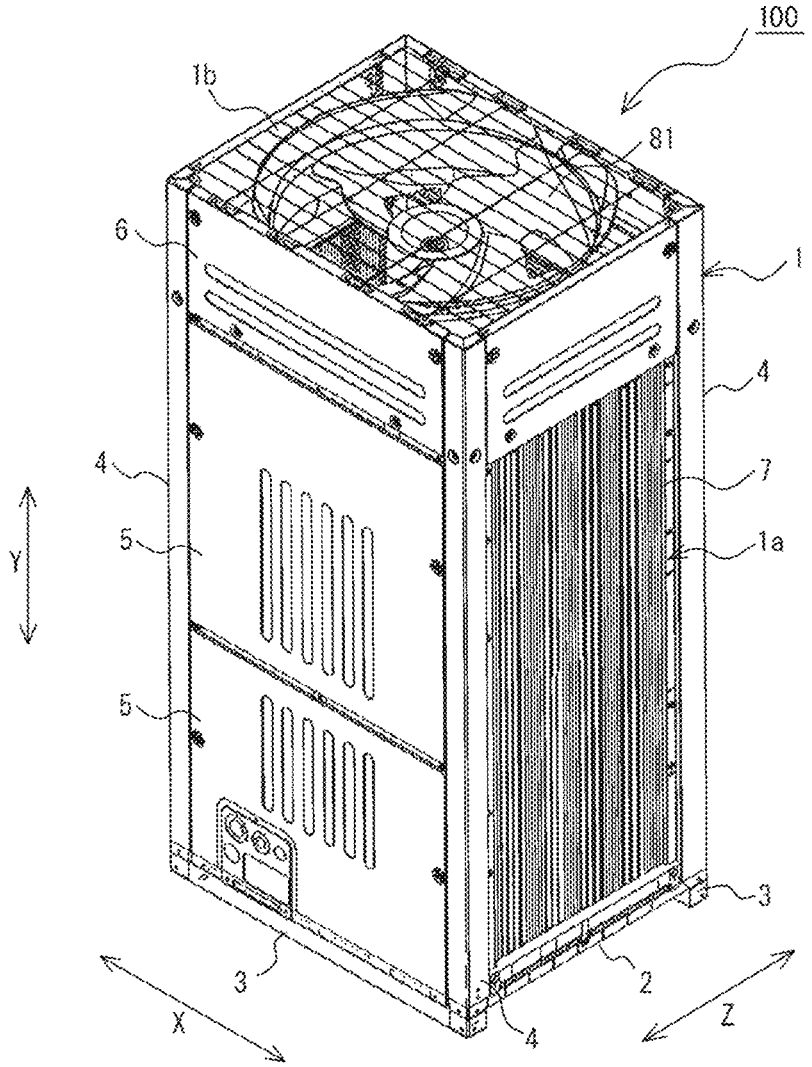
FIG. 1 is a perspective view illustrating the external appearance of a heat source unit according to Embodiment 1.

Hereinafter, an embodiment of the present disclosure will be described with reference to the drawings. Note that in the drawings, the same or equivalent parts will be denoted by the same reference numerals, and descriptions thereof will be appropriately omitted or simplified. The shape, size, location, and other factors of the constituent components described in the drawings may be appropriately changed.

Figure 2:
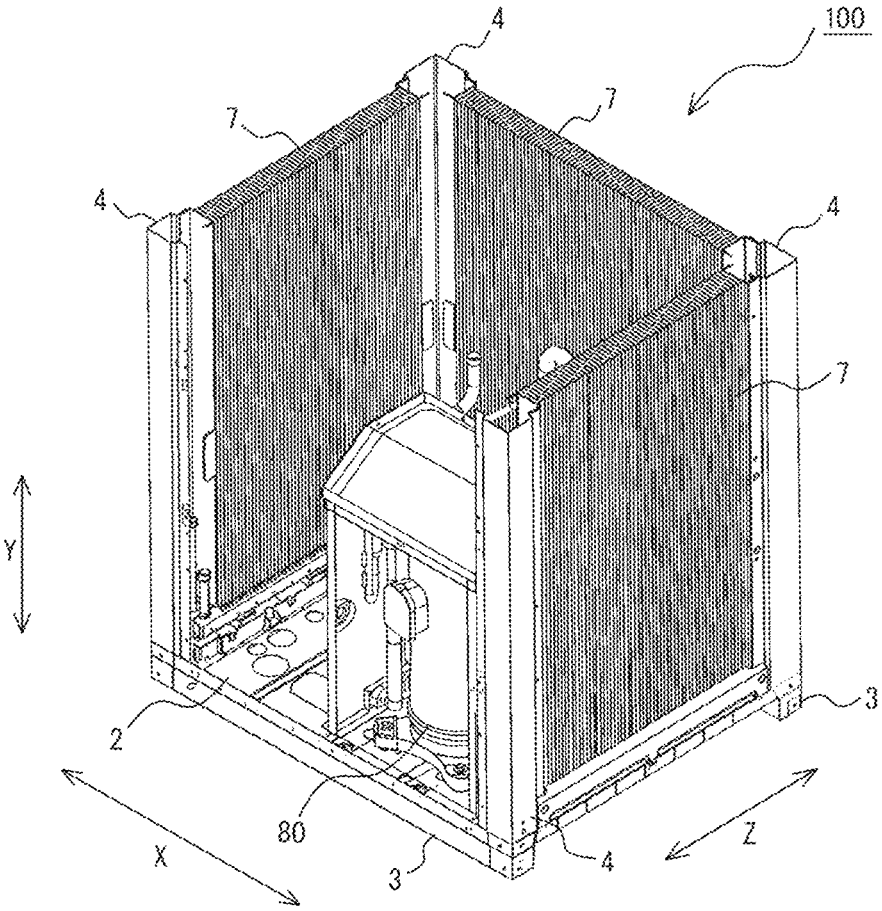
FIG. 2 is an explanatory view illustrating the internal structure of a lower portion of the heat source unit according to Embodiment 1.
Figure 3:
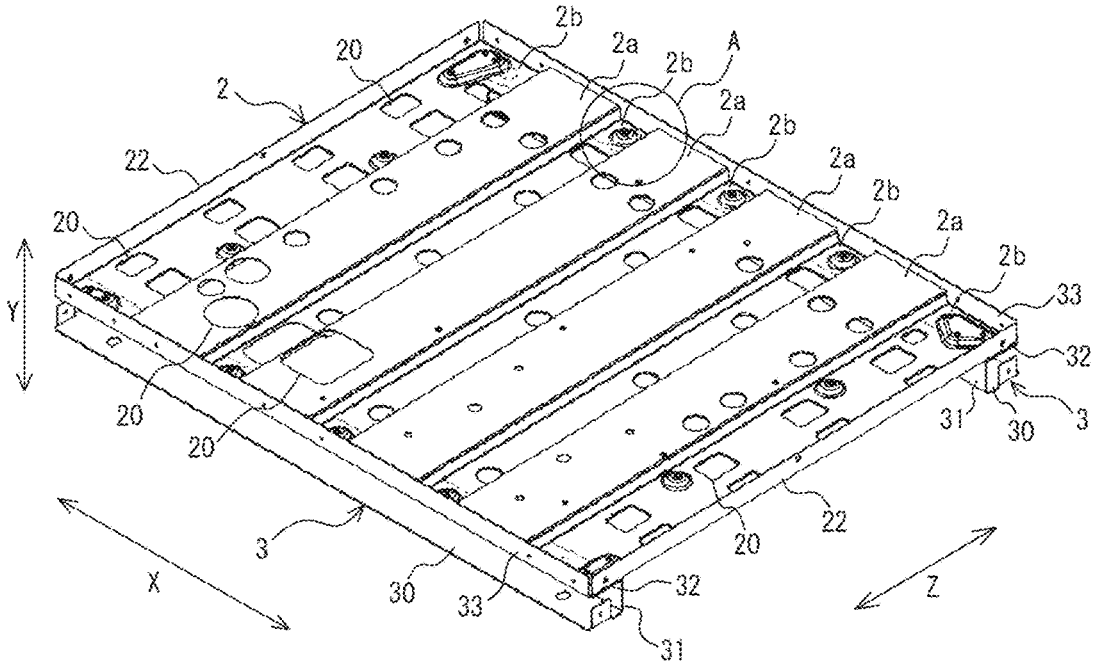
FIG. 3 is a perspective view illustrating a bottom plate of the heat source unit according to Embodiment 1 in a state in which the bottom plate is supported by support legs.
Figure 4:
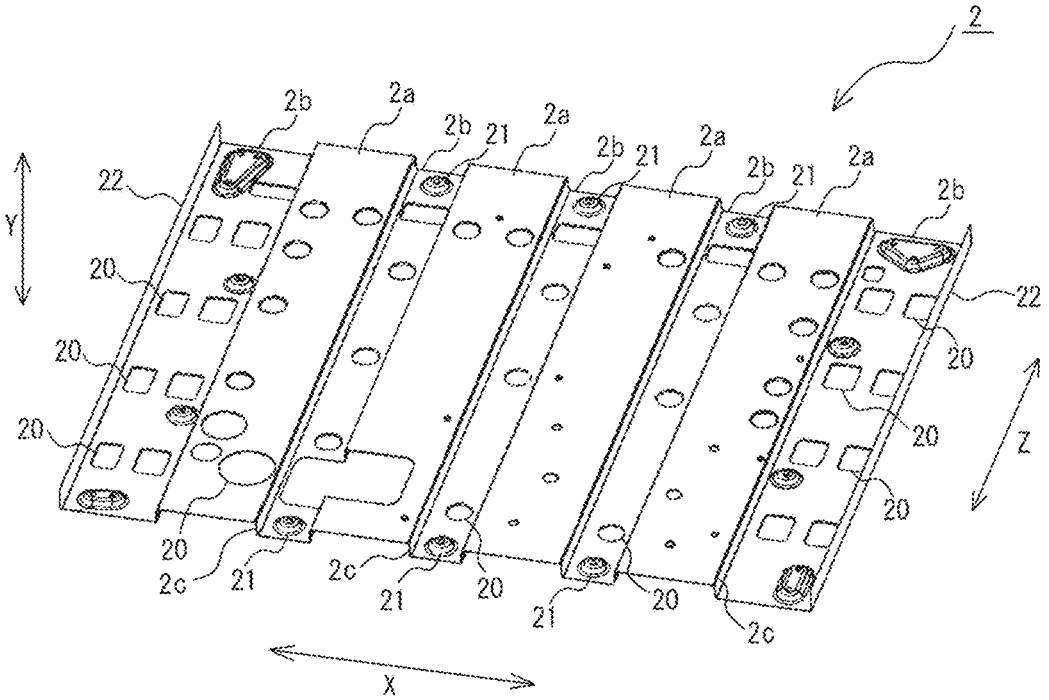
FIG. 4 is a perspective view illustrating the bottom plate of the heat source unit according to Embodiment 1.
Figure 5:
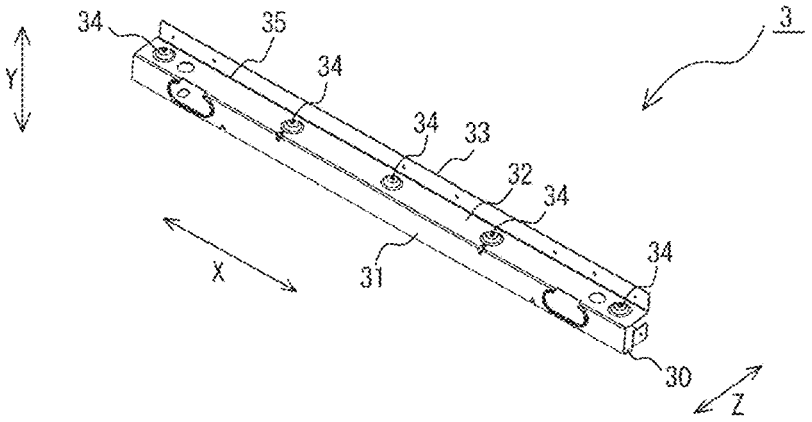
FIG. 5 is a perspective view illustrating the support leg of the heat source unit according to Embodiment 1.
Figure 6:
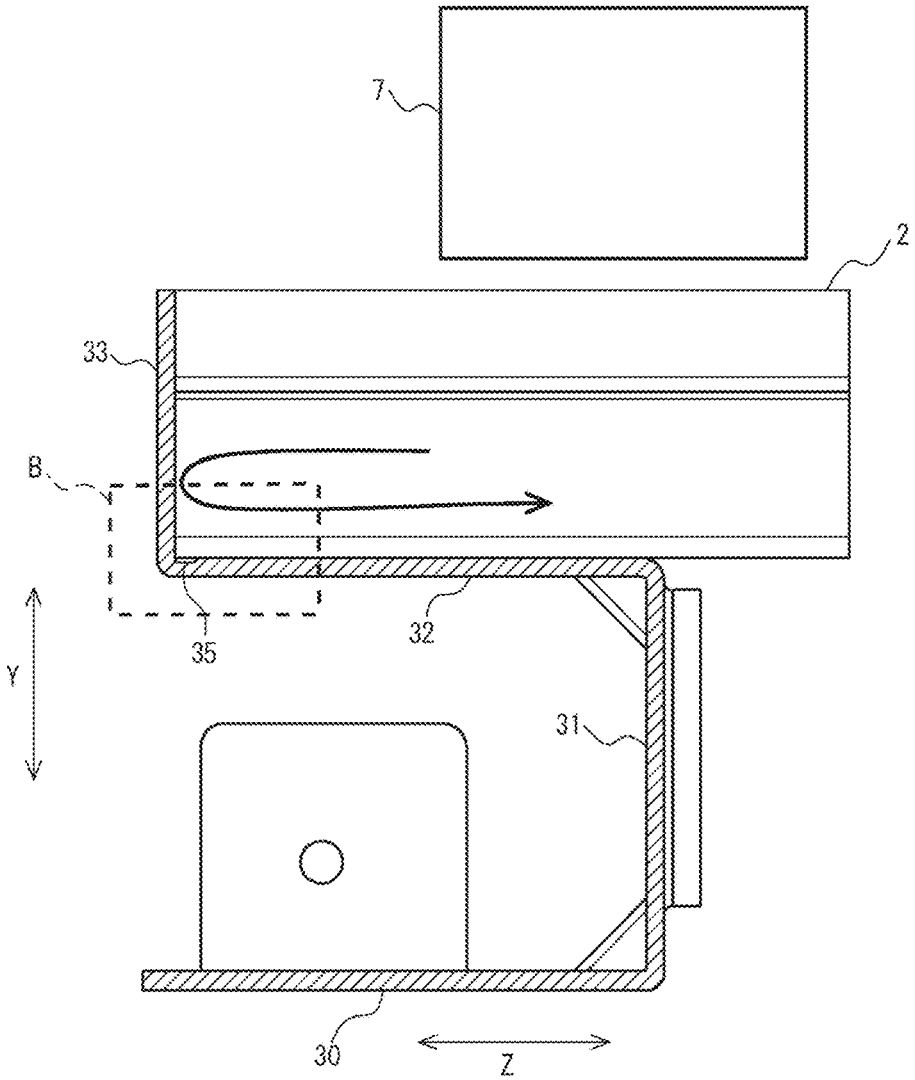
FIG. 6 is a cross-sectional view schematically illustrating the structure of an A portion illustrated in FIG. 3.
Figure 7:
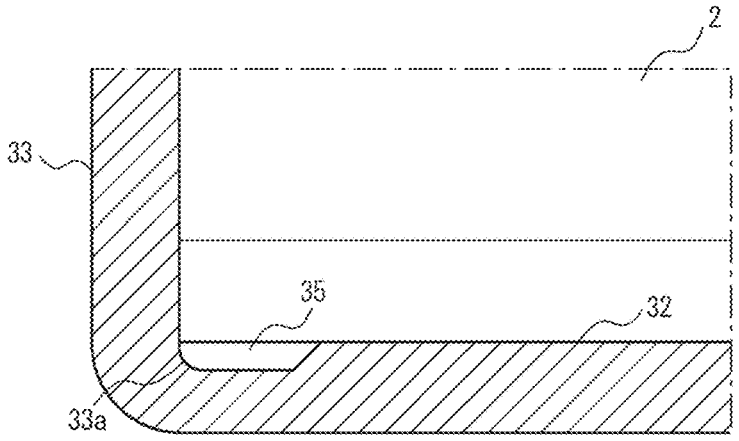
FIG. 7 is an enlarged view of a B portion illustrated in FIG. 6.

FIG. 1 is a perspective view illustrating the external appearance of a heat source unit 100 according to Embodiment 1. FIG. 2 is an explanatory view illustrating the internal structure of a lower portion of the heat source unit 100 according to Embodiment 1. FIG. 3 is a perspective view illustrating a bottom plate 2 of the heat source unit 100 according to Embodiment 1 in a state in which the bottom plate 2 is supported by support legs 3. FIG. 4 is a perspective view illustrating the bottom plate 2 of the heat source unit 100 according to Embodiment 1. FIG. 5 is a perspective view illustrating the support leg 3 of the heat source unit 100 according to Embodiment 1. FIG. 6 is a cross-sectional view schematically illustrating the structure of an A portion illustrated in FIG. 3. FIG. 7 is an enlarged view of a B portion illustrated in FIG. 6.

As illustrated in FIGS. 1 and 2, the heat source unit 100 in the present Embodiment 1 has a housing 1 with its longitudinal direction oriented vertically and having a substantially cuboid shape, a heat exchanger 7 provided along outer sides of the housing 1, and interior constituent components forming a refrigeration cycle, such as a compressor 80, an air-sending fan 81, an accumulator (not illustrated), and a refrigerant pipe (not illustrated) that are installed inside the housing 1.

As illustrated in FIG. 1, the housing 1 includes the bottom plate 2 forming a bottom side of the housing 1, and a pair of support legs 3 configured to support the bottom plate 2. The housing 1 further includes four frame materials 4 extending upward (in the Y-direction) from corner portions of the bottom plate 2, front panels 5 covering a front opening, and a fan casing 6 provided surrounding the air-sending fan 81.

As illustrated in FIGS. 3 and 4, the bottom plate 2 has a substantially rectangular shape, and forms the bottom side of the housing 1. The bottom plate 2 is placed on and supported by the pair of support legs 3 at opposite end portions of the bottom plate 2, between which ridge portions 2*a* and groove portions 2*b* extend. The bottom plate 2 is installed at a predetermined height from an installation surface. On a top surface of the bottom plate 2, the interior constituent components such as the compressor 80 are placed. The bottom plate 2 has a bottom surface that is formed by being bent into a square wave-like shape made up of a series of alternating ridge portions 2*a* and groove portions 2*b*. The ridge portions 2*a* and the groove portions 2*b* are formed individually to have a flat surface and substantially parallel to each other. Each of the ridge portions 2*a* and each of the groove portions 2*b* are connected by a connecting surface portion 2*c*. The connecting surface portion 2*c* may be perpendicular to, or inclined to, the ridge portion 2*a* and the groove portion 2*b*. That is, the bottom plate 2 may have a bottom surface formed into a rectangular wave-like shape, a trapezoidal wave-like shape, or other shape in cross-section. The bottom plate 2 has the bottom surface formed into a wave-like shape, which results in an increase in its rigidity when bending moment is loaded in a planar direction, and accordingly can increase its strength.

On the ridge portions 2*a* and the groove portions 2*b*, drainage holes 20 are formed through which drain water produced in the heat exchanger 7 and flowing through the bottom surface of the bottom plate 2 is drained to the exterior. Note that an adequate number of drainage holes 20 are formed at proper positions in consideration of the strength of the bottom plate 2 and efficiency in draining the drain water. Note that the positions where the drainage holes 20 are formed, and the number of the drainage holes 20 are not limited to those in the configuration illustrated in FIGS. 3 and 4, and may be appropriately changed depending on the installation location of the heat source unit 100, or the shape, size, and other factors of the bottom plate 2.

The groove portions 2*b* are arranged at opposite end portions of the bottom plate 2 in a direction of a series of the alternating ridge portions 2*a* and groove portions 2*b* (X-direction). On the groove portions 2*b* positioned at opposite end portions of the bottom plate 2, flange portions 22 are formed and bent upward from opposite edges of the bottom plate 2 along which these groove portions 2*b* extend.

As illustrated in FIGS. 1 to 3, the pair of support legs 3 is located below the bottom plate 2 to support the bottom plate 2. The support leg 3 is formed by bending a steel plate, and extends along the direction of a series of the alternating ridge portions 2*a* and groove portions 2*b* (X-direction). As illustrated in FIGS. 5 and 6, the support leg 3 has a flat installation portion 30 installed on the installation surface of the heat source unit 100, an upright portion 31 extending upward from one edge of the installation portion 30 along its longitudinal direction (X-direction), a support portion 32 bent horizontally from an upper edge of the upright portion 31 along its longitudinal direction (X-direction), and a wall portion 33 extending upward from a tip edge of the support portion 32 along its longitudinal direction (X-direction). The support leg 3 is formed into substantially a C-shape in vertical cross-section by the installation portion 30, the upright portion 31, and the support portion 32. Note that the definition of horizontal direction also includes a substantially horizontal direction, and the horizontal direction is not necessarily exactly horizontal.

On the support portion 32, the end portion of the bottom plate 2 is placed, and the ridge portions 2*a* and the groove portions 2*b* extend to this end portion. A lower surface of the groove portions 2*b* of the bottom plate 2 contacts an upper surface of the support portion 32. A positioning mechanism is formed on the bottom plate 2 and the support portions 32 to position the bottom plate 2 and the support portions 32 when the bottom plate 2 is placed on the support portions 32. The positioning mechanism has first embosses 21 formed on opposite end portions of the groove portions 2*b* placed on the support legs 3, and second embosses 34 formed on the support portions 32. The first embosses 21 are formed protruding upward from the upper surface of the groove portions 2*b*. A plurality of the first embosses 21 are formed and spaced apart from each other along a direction of a series of wave-like shape. The second embosses 34 are formed protruding upward from the upper surface of the support portions 32. A plurality of the second embosses 34 are formed along a longitudinal direction of the support portions 32. Each of the first embosses 21 and each of the second embosses 34 fit in each other when the bottom plate 2 is placed on the support portions 32. Each of the first embosses 21 and each of the second embosses 34 brought into a fit-in state are joined together by a joining part such as a screw from the lower surface of the bottom plate 2. A head portion of the joining part is accommodated in a recessed portion of the second emboss 34. The heat source unit 100 having the positioning mechanism can facilitate installation of the bottom plate 2 at a predetermined position. Note that the positions where the first embosses 21 and the second embosses 34 are formed, and the numbers of the first embosses 21 and the second embosses 34 are not limited to those in the configuration illustrated in FIGS. 3 and 4, and may be appropriately changed depending on the installation location of the heat source unit 100, or the shape, size, and other factors of the bottom plate 2.

The wall portion 33 is formed such that its wall surface faces the end portion of the bottom plate 2 placed on the support portion 32. A connection part 33*a* of the wall portion 33 and the support portion 32 has a bend R that is formed by bending. As illustrated in FIG. 3, the wall portion 33 is formed to have a height that is approximately equal to the height of the flange portion 22, and the wall portion 33 along with the flange portion 22 surround the bottom surface.

Next, other constituent components of the housing 1 are described. In the housing 1, as illustrated in FIGS. 1 and 2, air inlets 1*a* are formed on the left and right sides and the back side of the outer sides surrounded by the frame materials 4, through which air is drawn into the interior of the housing 1. A heat exchanger 7 is located along the air inlets 1*a*. The heat exchanger 7 allows refrigerant supplied to the heat exchanger 7 to exchange heat with air passing through the heat exchanger 7. During cooling operation, the heat exchanger 7 serves as a condenser to condense and liquefy the refrigerant. In contrast, during heating operation, the heat exchanger 7 serves as an evaporator to evaporate and gasify the refrigerant.

In the housing 1, as illustrated in FIG. 1, two front panels 5 of decorative sheet metal are provided vertically on the front side of the outer sides surrounded by the frame materials 4. The front side of the housing 1 is closed by the front panels 5. The front panels 5 are fixed along their left and right side edge portions to the frame materials 4 with fastening parts such as screws. As illustrated in FIG. 2, in the lower interior of the housing 1, the interior constituent components forming the refrigeration cycle are installed, such as the compressor 80 and the accumulator (not illustrated). In the heat source unit 100, the front panels 5 are removed from the housing 1 to open the interior to the exterior, so that it is possible to perform maintenance on the interior constituent components such as the compressor 80 and the accumulator.

On the top side of the housing 1, an air outlet 1*b* is formed. The air-sending fan 81 is disposed in the housing 1 at a position immediately below the air outlet 1*b*. The air-sending fan 81 is, for example, a propeller fan and is driven by a motor (not illustrated). When this air-sending fan 81 is driven by the motor, air suctioned into the housing 1 from the air inlets 1*a* passes through the heat exchanger 7 and exchanges heat with refrigerant, and is thereafter discharged from the air outlet 1*b* via the air-sending fan 81. The air-sending fan 81 is surrounded by the fan casing 6 attached to the housing 1. The fan casing 6 is located on the outer sides surrounded by the frame materials 4 above the front panels 5 and the heat exchanger 7, and is configured to surround the air-sending fan 81.

In the heat source unit 100, since drain water produced in the heat exchanger 7 flows through the bottom surface of the bottom plate 2, the drain water needs to be drained from the bottom plate 2 to the exterior. For example, it is conceivable that a clearance is provided between the end portion of the bottom plate 2 and the wall portion 33, and this clearance is used as a drainage channel. However, since the heat exchanger 7 is located along an outer peripheral edge of the bottom plate 2, the clearance serving as the drainage channel is located in vicinity to the bottom of the heat exchanger 7. In addition, the end portion of the bottom plate 2 is supported on the upper surface of the support portion 32. For this reason, in order that the bottom plate 2 is supported in a stabilized manner, the width of the clearance cannot be increased any further. However, a small width of the clearance prevents a sufficient amount of water from being drained, so that the water is more likely to accumulate in the clearance. For this reason, in a case where the heat source unit 100 is installed in a cold region, water accumulating in the clearance freezes into ice. The ice may grow up to the heat exchanger 7 positioned above the clearance, and is likely to damage the heat exchanger 7.

It is therefore desirable that the end portion of the bottom plate 2 abuts against a wall surface of the wall portion 33 to close the clearance, and drain water collected on the bottom surface of the bottom plate 2 is drained from the drainage holes 20 formed on the ridge portions 2*a* and the groove portions 2*b* of the bottom plate 2. However, the support leg 3 is formed by bending, and the bend R is formed at the corner portion that is the connection part 33*a* of the support portion 32 and the wall portion 33. Due to this structure, even when the end portion of the bottom plate 2 is attempted to abut against the wall surface of the wall portion 33, the edge of the groove portions 2*b* abuts against the bend R, which still causes a slight clearance between the bottom plate 2 and the wall portion 33.

In view of that, in the heat source unit 100 according to the present Embodiment 1, as illustrated in FIGS. 6 and 7, a recessed portion 35 is formed along the longitudinal direction of the support leg 3 (X-direction) on the upper surface of the support portion 32 at the connection part 33*a* of the wall portion 33 and the support portion 32. Specifically, the recessed portion 35 is formed on the upper surface of the support portion 32 by means of, for example, striking at a portion where the bend R is formed. The striking allows the recessed portion 35 to be formed without increasing the workload during the process of forming the support leg 3. It is thus possible to prevent the increase in manufacturing costs. Note that other machining method may also be employed, provided that it is still possible to form the recessed portion 35 on the upper surface of the support portion 32. The recessed portion 35 is formed to have a depth greater than the radius of the bend R such that the bend R is completely accommodated in the recessed portion 35. The bottom plate 2 is installed in such a manner that its end portion, to which the ridge portions 2*a* and the groove portions 2*b* extend, passes over the recessed portion 35 and abuts against the wall surface of the wall portion 33. With this installation, as illustrated in FIGS. 6 and 7, it is possible to close the clearance between the wall portion 33 and the bottom plate 2 which is located in vicinity to the bottom of the heat exchanger 7. Since the clearance between the bottom plate 2 and the wall portion 33 is closed, drain water flowing through, and collected on, the bottom surface of the bottom plate 2 hits the wall surface of the wall portion 33 and is then guided to the drainage holes 20 formed on the bottom plate 2 as illustrated by the arrow in FIG. 6. Consequently, the heat source unit 100 according to the present Embodiment 1 allows water collected on the bottom surface of the bottom plate 2 to be drained from the drainage holes 20 located away from the heat exchanger 7 without accumulating at the corner portion. It is therefore possible to prevent the heat exchanger 7 from being damaged due to growth of ice.

Figure 8:
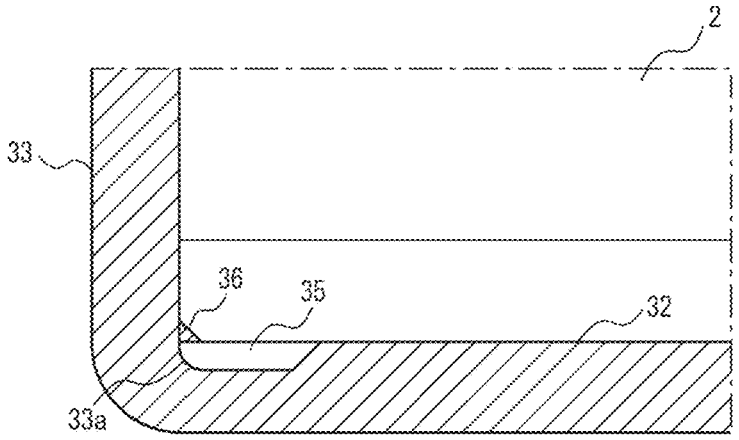
FIG. 8 is an explanatory view illustrating a modification of the heat source unit according to Embodiment 1.

FIG. 8 is an explanatory view illustrating a modification of the heat source unit 100 according to Embodiment 1. In the heat source unit 100 according to the present Embodiment 1, even when the bottom plate 2 is installed in such a manner that the end portion of the bottom plate 2, to which the ridge portions 2*a* and the groove portions 2*b* extend, passes over the recessed portion 35 and abuts against the wall surface of the wall portion 33, a slight clearance may still be possibly made between the end portion of the bottom plate 2 and the wall surface of the wall portion 33 due to dimensional tolerances of the constituent parts. In that case, a water stop part 36 made of resin material can be used to close the slight clearance between the end portion of the bottom plate 2 and the wall surface of the wall portion 33, as illustrated in FIG. 8. This allows the clearance between the end portion of the bottom plate 2 and the wall surface of the wall portion 33 to be completely closed, and can accordingly improve the above functional effect. However, it is allowable that the water stop part 36 is not necessarily provided. Even in this case where the water stop part 36 is not provided, the above effect can still be sufficiently achieved.

Embodiment 2

Figure 9:
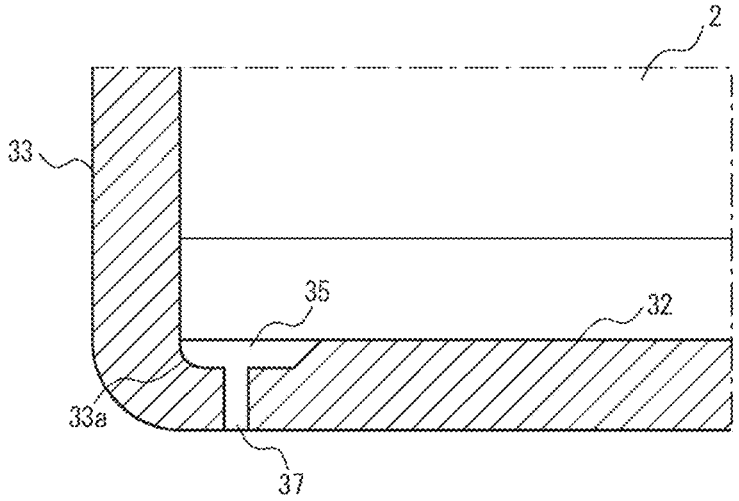
FIG. 9 is an enlarged explanatory view illustrating a relevant part of the heat source unit according to Embodiment 2.

Next, the heat source unit 100 according to the present Embodiment 2 is described with reference to FIG. 9. FIG. 9 is an enlarged explanatory view illustrating a relevant part of the heat source unit 100 according to Embodiment 2. Note that the same constituent elements as those of the heat source unit 100 described in Embodiment 1 are denoted by the same reference signs, and descriptions thereof are appropriately omitted.

As described above, also in the heat source unit 100 according to the present Embodiment 2, the recessed portion 35 is formed on the upper surface of the support portion 32 at the connection part 33*a* of the wall portion 33 and the support portion 32. The bottom plate 2 is installed in such a manner that its end portion, to which the ridge portions 2*a* and the groove portions 2*b* extend, passes over the recessed portion 35 and abuts against the wall surface of the wall portion 33. However, as described above, a slight clearance may possibly be made between the end portion of the bottom plate 2 and the wall surface of the wall portion 33 due to the dimensional tolerances of the constituent parts. Due to this structure, drain water may enter the recessed portion 35 from this slight clearance, and then may possibly freeze into ice in the recessed portion 35.

In view of the above, in the heat source unit 100 according to the present Embodiment 2, a through hole 37 communicating with the exterior is formed at the recessed portion 35, as illustrated in FIG. 9. The through hole 37 is provided to drain the water having entered the recessed portion 35 to the exterior. A plurality of the through holes 37 are formed and spaced apart from each other along the longitudinal direction of the support leg 3 (X-direction). The size and shape of the through holes 37 are appropriately changed depending on the installation location of the heat source unit 100, or the shape, size, and other factors of the bottom plate 2. Note that, to improve the efficiency in draining water from the through holes 37, the recessed portion 35 may have an inclined bottom surface, or may be provided with a part that guides the water to the through holes 37.

As described above, in the heat source unit 100 according to the present Embodiment 2, the through holes 37 communicating with the exterior are formed at the recessed portion 35. Consequently, even if water may enter the recessed portion 35 from the slight clearance between the end portion of the bottom plate 2 and the wall surface of the wall portion 33, it is still possible to drain the water through the through holes 37 to the exterior.

While the heat source unit 100 has been described above based on the embodiments, the heat source unit 100 is not limited to having the configuration in the above embodiments. The configuration of the heat source unit 100 described above is merely an example, and may include other constituent elements or may omit some of the constituent elements. To sum up, the heat source unit 100 includes design modifications and application variations that are usually made by those skilled in the art without departing from the scope of the technical concept.

REFERENCE SIGNS LIST

1: housing, 1*a*: air inlet, 1*b*: air outlet, 2: bottom plate, 2*a*: ridge portion, 2*b*: groove portion, 2*c*: connecting surface portion, 3: support leg, 4: frame material, 5: front panel, 6: fan casing, 7: heat exchanger, 20: drainage hole, 21: first emboss, 22: flange portion, 30: installation portion, 31: upright portion, 32: support portion, 33: wall portion, 33*a*: connection part, 34: second emboss, 35: recessed portion, 36: water stop part, 37: through hole, 80: compressor, 81: air-sending fan, 100: heat source unit

The invention claimed is:

1. A heat source unit comprising:

a bottom plate having a series of alternating ridge portions and groove portions; and a pair of support legs located at opposite end portions of the bottom plate, between which the ridge portions and groove portions extend, the pair of support legs being configured to support the opposite end portions, wherein each of the support legs has a support portion on which an end portion of the bottom plate is placed, and a wall portion extending upward from the support portion, on an upper surface of the support portion, a recessed portion is formed at a connection part of the wall portion and the support portion, the bottom plate is installed in such a manner that an end portion of the bottom plate, to which the ridge portions and groove portions extend, passes over the recessed portion and abuts against a wall surface of the wall portion, the connection part has a bend, and the recessed portion is formed to have a depth greater than a radius of the bend.

2. The heat source unit of claim 1, wherein a positioning mechanism is formed on the bottom plate and the support portion to position the bottom plate and the support portion when the bottom plate is placed on the support portion.

3. The heat source unit of claim 1, wherein a water stop part is provided at a portion where the wall surface of the wall portion and an end portion of the bottom plate, to which the ridge portions and groove portions extend, abut against each other.

4. The heat source unit of claim 1, wherein a through hole communicating with an exterior of the bottom plate is formed at the recessed portion.

5. The heat source unit of claim 2, wherein a water stop part is provided at a portion where the wall surface of the wall portion and an end portion of the bottom plate, to which the ridge portions and groove portions extend, abut against each other.

6. The heat source unit of claim 2, wherein a through hole communicating with an exterior of the bottom plate is formed at the recessed portion.

7. The heat source unit of claim 1, wherein the recessed portion extends from the bend along a longitudinal direction of the support leg.

8. The heat source unit of claim 2, wherein the recessed portion extends from the bend along a longitudinal direction of the support leg.

* * * * *